US006983898B2

(12) United States Patent
Clark

(10) Patent No.: US 6,983,898 B2
(45) Date of Patent: Jan. 10, 2006

(54) SHOWERHEAD WITH OPTICAL LENS FEATURE

(76) Inventor: Frank Clark, P.O. Box 205, Costilla, NM (US) 87524

( * ) Notice: Subject to any disclaimer, the term of this patent is extended or adjusted under 35 U.S.C. 154(b) by 34 days.

(21) Appl. No.: 10/443,300

(22) Filed: May 21, 2003

(65) Prior Publication Data

US 2004/0251323 A1 Dec. 16, 2004

(51) Int. Cl.
*B05B 1/14* (2006.01)
*F21S 8/00* (2006.01)

(52) U.S. Cl. ..... 239/548; 239/18; 239/567; 239/557; 239/568

(58) Field of Classification Search ..... 239/548, 239/17, 18, 19, 525, 567, 556, 557, 558, 239/568; 362/96, 234, 555, 211; 359/591, 359/599, 652, 647
See application file for complete search history.

(56) References Cited

U.S. PATENT DOCUMENTS

| | | | | |
|---|---|---|---|---|
| 4,975,811 A | * | 12/1990 | Fraser et al. | 362/96 |
| 5,823,431 A | * | 10/1998 | Pierce | 239/19 |
| 6,021,960 A | * | 2/2000 | Kehat | 239/289 |
| 6,126,290 A | * | 10/2000 | Veigel | 362/96 |
| 6,439,472 B1 | * | 8/2002 | Lin et al. | 239/18 |
| 6,644,561 B1 | * | 11/2003 | Daane | 239/18 |
| 2002/0158153 A1 | | 10/2002 | Zeiger et al. | |

FOREIGN PATENT DOCUMENTS

| | | | |
|---|---|---|---|
| DE | 91 09 457.7 U | | 10/1999 |
| JP | 02307553 | | 12/1990 |
| JP | 02307553 A | * | 12/1990 |

OTHER PUBLICATIONS

Website: http://store.yahoo.com/electricsupplieson–line/–lr13–.html Model LR13.*
Website: www.lampsontheweb.com/Frames/Items/005684.html SKU #005684.*
Website: http://www.airshack.com/Merchant2/merchant.mvc?Screen=PROD&Store_Code=FCFAA&Product_Code=ASI–A19 Code: ASI–A19 Model–A19.*

* cited by examiner

*Primary Examiner*—David A. Scherbel
*Assistant Examiner*—Seth Barney
(74) *Attorney, Agent, or Firm*—DLA Piper Rudnick Gray Cary US LLP

(57) ABSTRACT

A showerhead as described herein includes a translucent hollow body having a fluid chamber, and a fluid distribution element configured to release fluid contained in the fluid chamber. The fluid distribution element includes a plurality of raised concentric rings having peaks that serve as the fluid release points. The fluid distribution element contains a number of fluid ducts that are specifically shaped to transport the fluid from the fluid chamber toward the fluid release points. The translucent nature of the showerhead creates an optical lens effect that illuminates the showerhead and the water droplets formed by the showerhead. The illumination of the water droplets creates a pleasant showering experience for the user.

19 Claims, 13 Drawing Sheets

SHOWERHEAD WITH OPTICAL LENS FEATURE

RELATED APPLICATION

The subject matter disclosed herein is related to the subject matter contained in U.S. patent application Ser. No. 10/443,405, titled SHOWERHEAD WITH GROOVED WATER RELEASE DUCTS.

FIELD OF THE INVENTION

The present invention relates generally to shower fixtures. More particularly, the present invention relates to a showerhead.

BACKGROUND OF THE INVENTION

The prior art is replete with showerhead designs. Conventional showerheads utilize unmodified free flow water pressure to generate a spray of water. Water exiting a traditional showerhead is sent in a single direction by the force of the water pressure created in the supply plumbing. Such systems tend to consume a substantial amount of fresh water, most of which is wasted. Furthermore, most known showerheads produce a relatively narrow shower of water rather than distributing the water over a wide area. Such narrowly focused showerheads do not produce an effective stream of water that efficiently provides a wide area of water coverage to the person taking the shower. In addition, traditional showerheads are merely designed to provide a stream or spray of water to the user. Such showerheads are not designed to provide pleasant visual effects to the user during use.

BRIEF SUMMARY OF THE INVENTION

A showerhead according to the present invention produces an efficient and effective shower of water in a manner that conserves water. In contrast to many prior art designs, the showerhead distributes water over a relatively wide area without relying on wasteful free flow water pressure obtained directly from the supply plumbing.

In addition, a showerhead according to the invention employs an optical lens feature that provides pleasant visual effects to the user. The optical lens feature, combined with the cascading water, creates an invigorating and enjoyable showering environment.

Certain aspects of the present invention may be carried out in one form by a showerhead having a fluid distribution element for releasing fluid from a fluid source. The fluid distribution element includes: an interior side facing the fluid source and an exterior side opposite the interior side; and one or more ducts formed within the fluid distribution element, each having an inlet hole for receiving fluid from the fluid source, and a groove connected to the inlet hole, the groove being configured to laterally transport fluid across the fluid distribution element from the inlet hole toward a fluid release point on the exterior side.

Certain aspects of the present invention may be carried out in one form by a showerhead having an optical lens element configured to receive incident light rays, refract the incident light rays, and create exiting light rays that illuminate outgoing fluid emitted from the showerhead.

BRIEF DESCRIPTION OF THE DRAWINGS

A more complete understanding of the present invention may be derived by referring to the detailed description and claims when considered in conjunction with the following Figures, wherein like reference numbers refer to similar elements throughout the Figures.

DETAILED DESCRIPTION OF A PREFERRED EMBODIMENT

Figure 1:
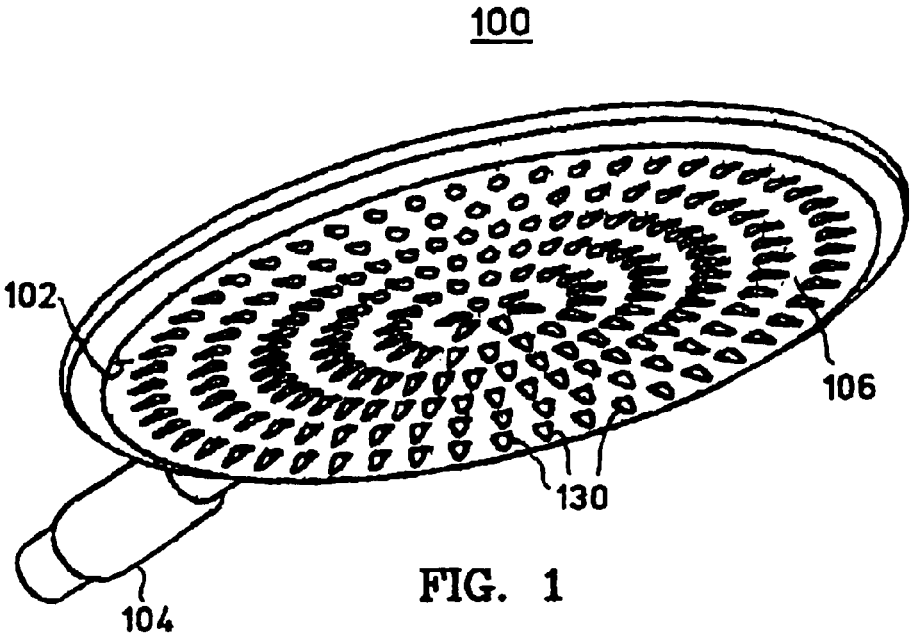
FIG. 1 is a perspective view of a showerhead, showing its water distribution side.
Figure 2:
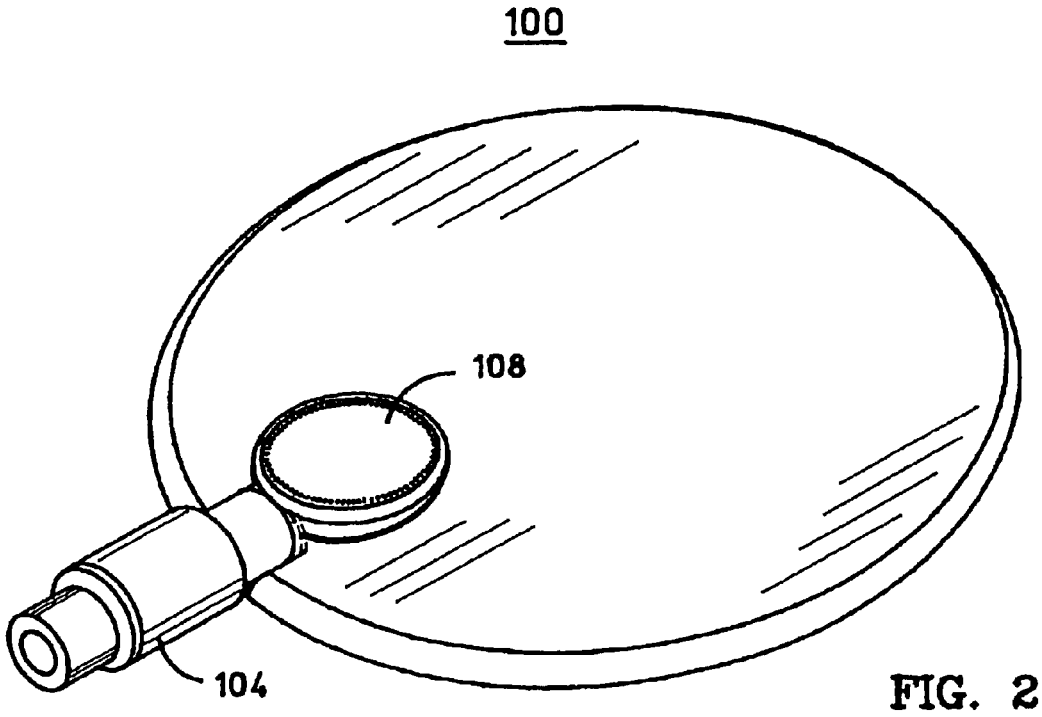
FIG. 2 is a perspective view of the showerhead of FIG. 1, showing its water spray nozzle side.
Figure 3:
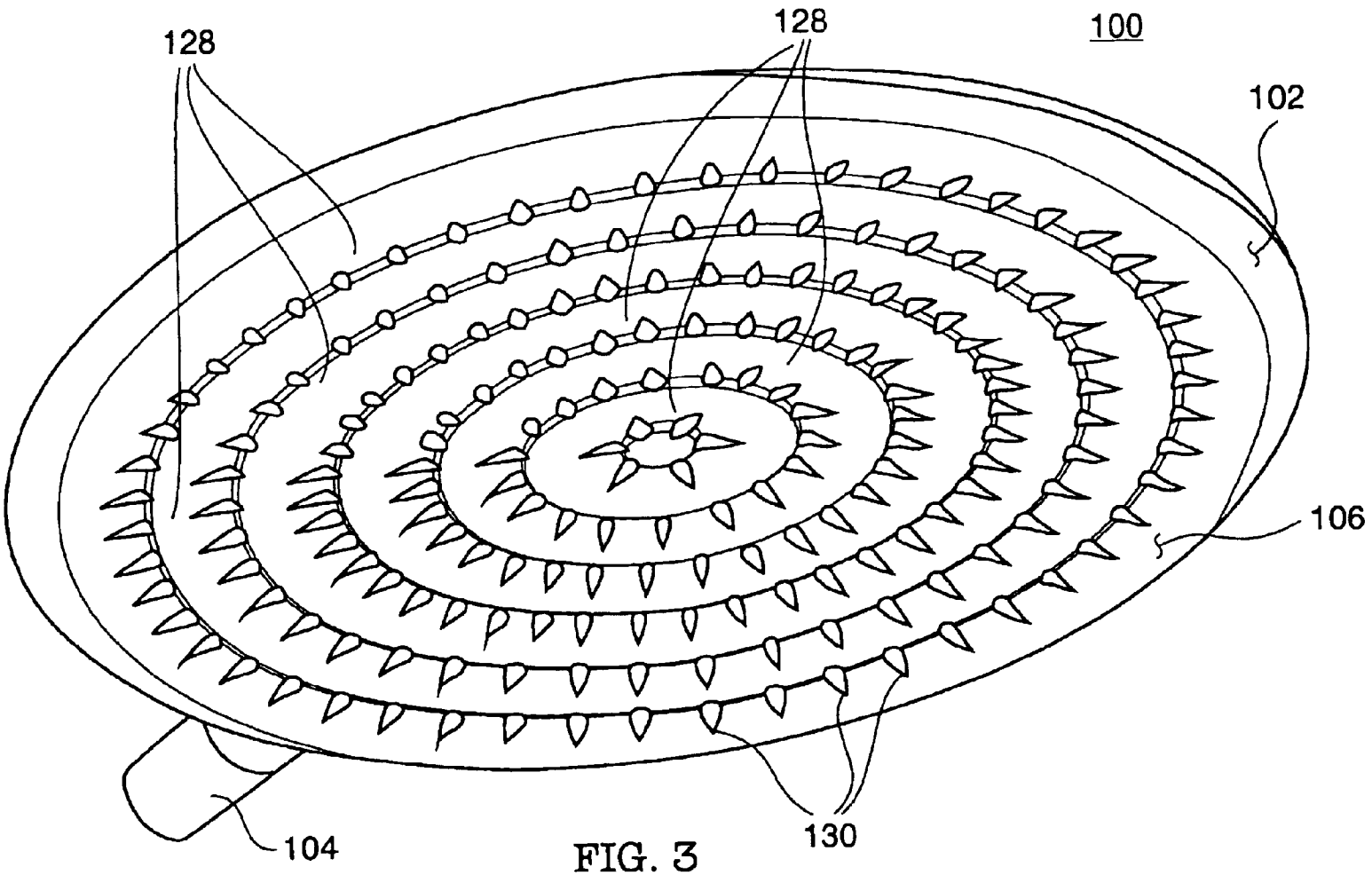
FIG. 3 is a three-dimensional perspective rendition of the water distribution side of the showerhead shown in FIG. 1.

FIG. 1 is a perspective view of one side of a showerhead 100, and FIG. 2 is a perspective view of the other side of the showerhead 100. FIG. 1 shows the water distribution side of the showerhead 100, while FIG. 2 shows the water spray nozzle side of the showerhead 100. FIG. 3 is a three-dimensional perspective rendition of the water distribution side of the showerhead 100, showing the contoured/textured water distribution surface 102 of the showerhead 100.

In typical installations, the showerhead 100 is attached to a plumbing feature, e.g., a water pipe, that protrudes from a wall. Of course, the showerhead 100 may be installed in any number of alternate mounting configurations. The showerhead 100 may be connected to the water pipe via a suitable conduit, which may include one or more interconnected pipes, hoses, or the like. The showerhead 100 may include a suitably configured mounting element 104, e.g., a swivel joint, a telescoping joint, a ball joint, or a rotating joint. The mounting element 104 allows the user to adjust the position of the showerhead 100 and, consequently, the direction of the exiting water flow. In one embodiment, mounting element 104 incorporates a feed valve assembly for directing water flow to either a water distribution element or a water spray nozzle (described in more detail below). Although not a requirement of the invention, the showerhead 100 may include a flow valve (not shown) for controlling the flow of fluid entering showerhead 100. The flow valve may be utilized in conjunction with existing hot and cold water valves (or a combined hot and cold water regulator) to provide an added measure of water flow control.

Although the showerhead shown and described herein includes a side-mounted water feed, the present invention is not so limited. Indeed, the features described below can also be extended for use in connection with a top-mounted showerhead and with other configurations and arrangements that may not be specifically addressed herein.

The showerhead 100 is suitably configured to support at least two modes of operation: (1) the gentle distribution of water droplets over a relatively wide area; and (2) a stream or spray of water as typically produced by conventional showerheads. In the first operating mode, water is routed within the showerhead 100 for release by a water distribution element 106 (upon which the water distribution surface 102 is formed). The water distribution element 106, and certain aspects thereof, are shown in FIGS. 11–14. In the second operating mode, water is routed within the showerhead 100 to a water spray nozzle 108. In the example embodiment, the water spray nozzle 108 is located on one side of the showerhead 100, and the water distribution element 106 is located on the opposite side of the showerhead 100.

Figure 15:
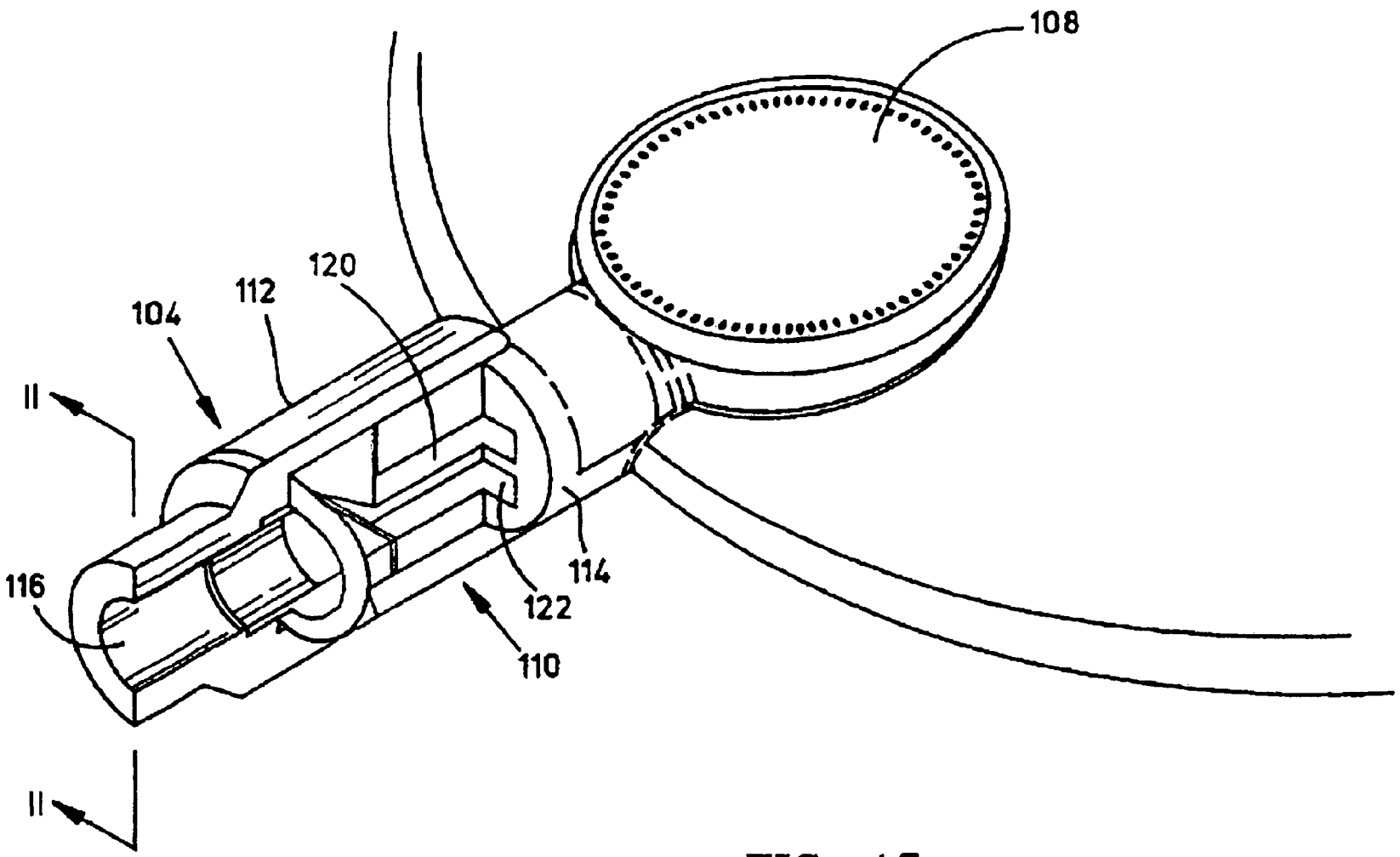
FIG. 15 is a partial cutaway view of a feed valve assembly suitable for use with the showerhead shown in FIG. 1.
Figure 16:
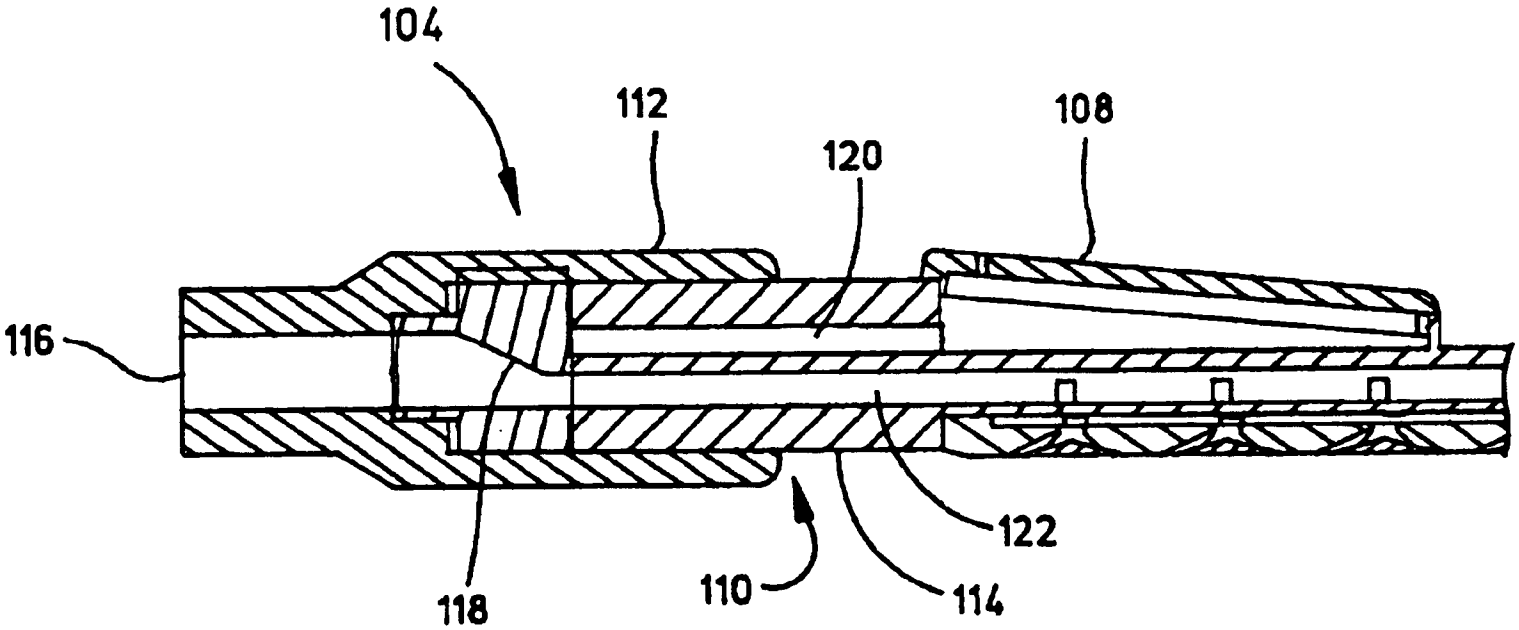
FIG. 16 is a sectional view of the feed valve assembly (in a water distribution mode) as viewed from line B—B in FIG. 15.
Figure 17:
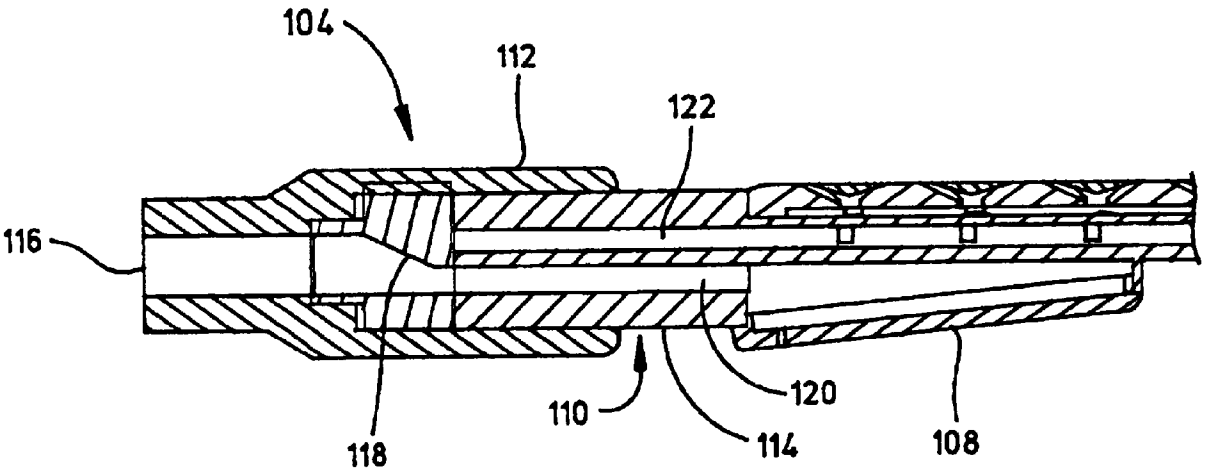
FIG. 17 is a sectional view of the feed valve assembly (in a water spray mode) as viewed from line B—B in FIG. 15.

In the example embodiment, the particular mode of operation is selected by rotating the main body of the showerhead 100 such that the appropriate side is facing the user. The rotating action results in the selectable engagement of a feed valve assembly 110, which may be incorporated into the mounting element 104. FIG. 15 is a partial cutaway view of the feed valve assembly 110, FIG. 16 is a sectional view of the feed valve assembly 110 (in the water distribution mode) as viewed from line B—B in FIG. 15, and FIG. 17 is a sectional view of the feed valve assembly 110 (in a water spray mode) as viewed from line B—B in FIG. 15. FIG. 15 also depicts the feed valve assembly 110 operating in the water distribution mode.

Briefly, the feed valve assembly 110 includes an outer section 112 (which also serves as the fluid inlet for the showerhead 100) coupled to an inner section 114. The inner section 114 is designed to rotate within the outer section 112. In the practical embodiment, the inner section 114 can be formed as an integral part of the main body section of the showerhead 100. In practice, the feed valve assembly 110 may include washers, seals, O-rings, or other features to prevent fluid leakage. The feed valve assembly 110 may also include structure or elements that temporarily "lock" the showerhead into the proper operating position.

The outer section 112 receives the incoming fluid at an inlet 116. As best shown in FIG. 16 and FIG. 17, the height of the inlet 116 decreases at a neck 118 formed within the outer section 112. The neck 118 directs the fluid flow into the inner section 114. The inner section 114 includes two inlet channels formed therein (designated by the reference numbers 120 and 122). Inlet channel 120 represents the fluid inlet for the water spray nozzle 108, and inlet channel 120 represents the fluid inlet for the water distribution element 106. In the example embodiment, the two inlet channels are distinct and separate. When the main body of the showerhead 100 is rotated into the position shown in FIG. 16, the inner section 114 swivels such that the inlet channel 122 becomes aligned with the necked portion of the inlet 116 formed within the outer section 112. This positioning allows the incoming fluid to be directed into the inlet channel 122 and, ultimately, to be released by the fluid distribution element 106. In contrast, when the main body of the showerhead 100 is rotated into the position shown in FIG. 17, the inner section 114 swivels such that the inlet channel 120 becomes aligned with the necked portion of the inlet 116. This allows the incoming fluid to be directed into the inlet channel 120 and, ultimately, to be sprayed from the fluid spray nozzle 108.

Figure 4:
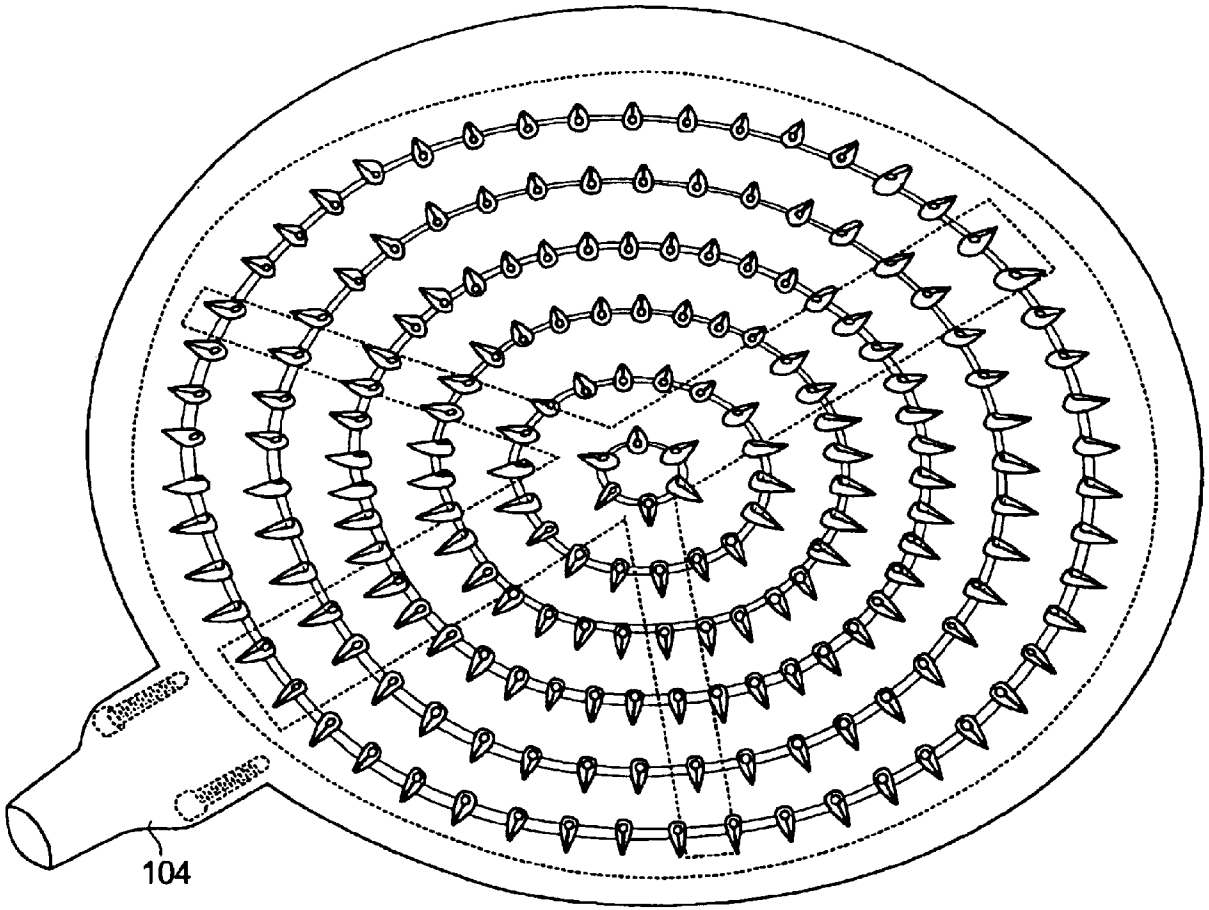
FIG. 4 is a three-dimensional perspective rendition of a showerhead, showing the translucent/transparent characteristics of the showerhead.

The showerhead 100 need not include the spray nozzle 108 and the dual-action feed valve assembly 110. For example, FIG. 4 depicts an alternate embodiment that only incorporates a fluid distribution element. FIG. 4 is a three-dimensional perspective rendition of a showerhead, showing the translucent (or transparent) characteristics of the showerhead. In this embodiment, the fluid inlet, which is incorporated into the mounting element 104, directs the fluid into the fluid chamber formed within the main body of the showerhead.

Figure 5:
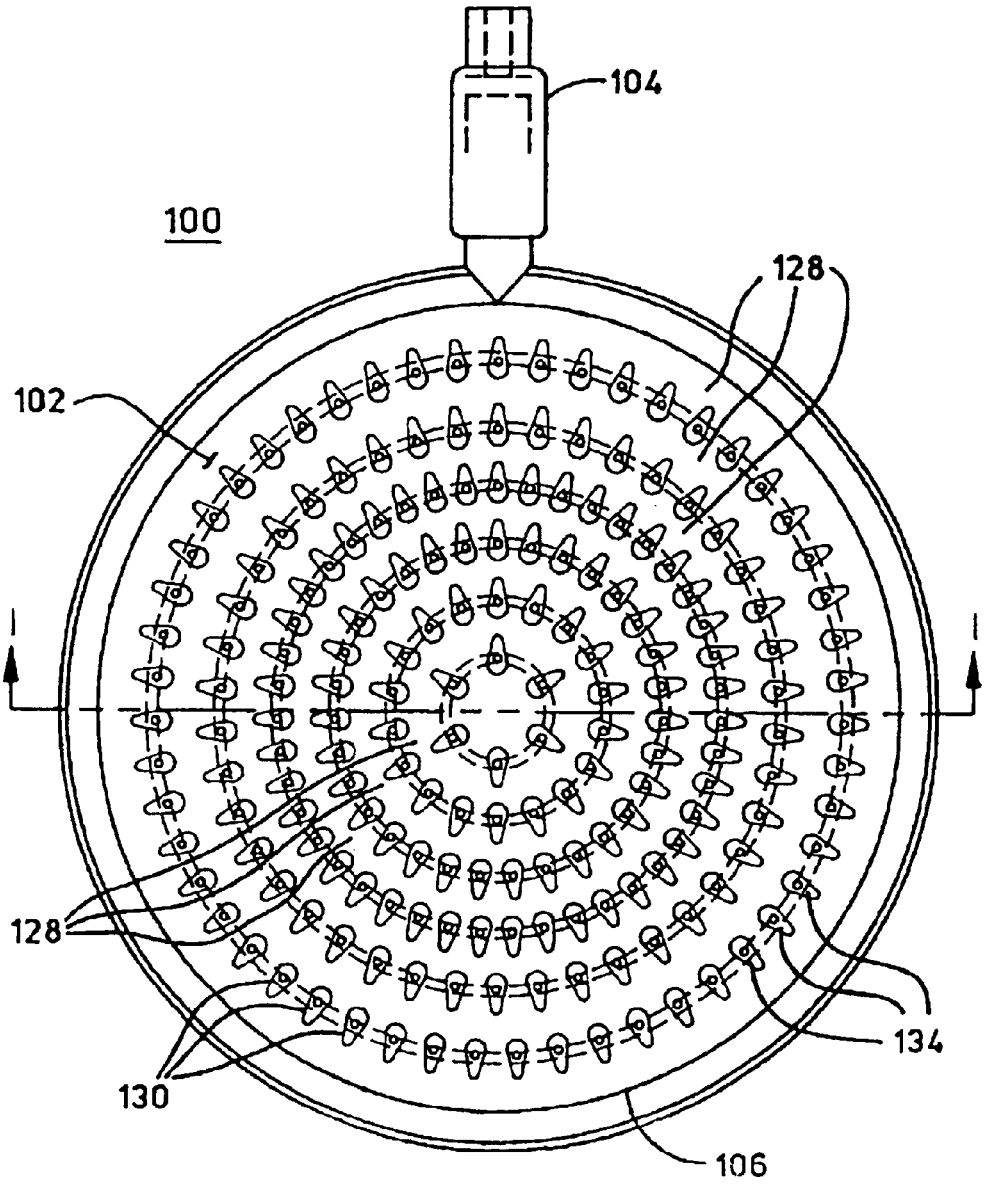
FIG. 5 is a plan view of the water distribution side of the showerhead shown in FIG. 1.
Figure 6:
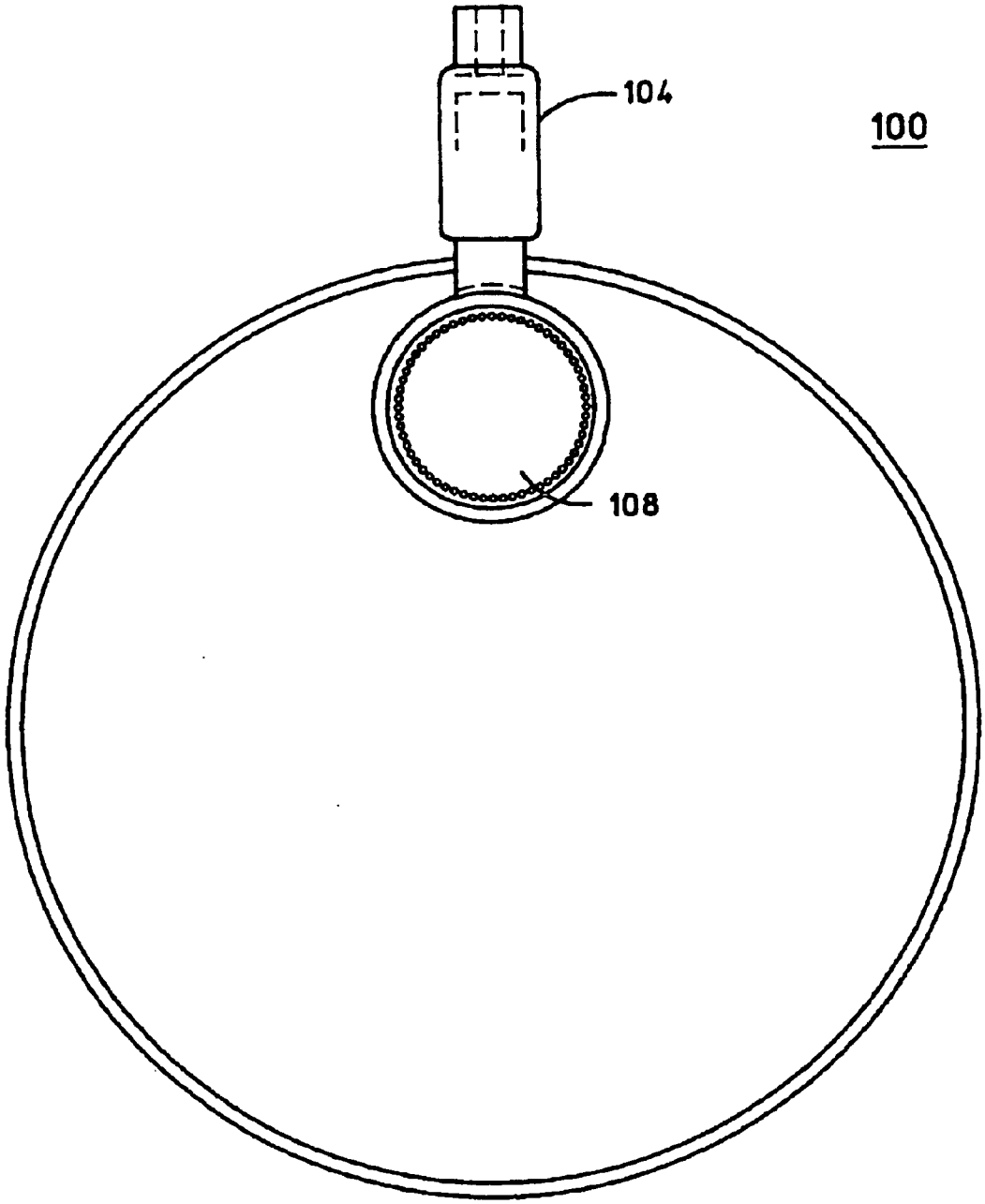
FIG. 6 is a plan view of the water spray nozzle side of the showerhead shown in FIG. 1.
Figure 7:
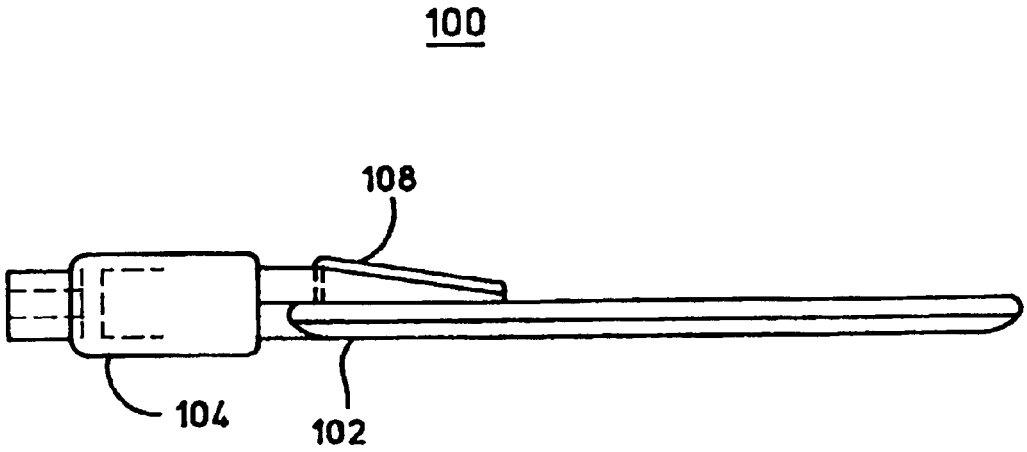
FIG. 7 is a side view of the showerhead shown in FIG. 1.
Figure 8:
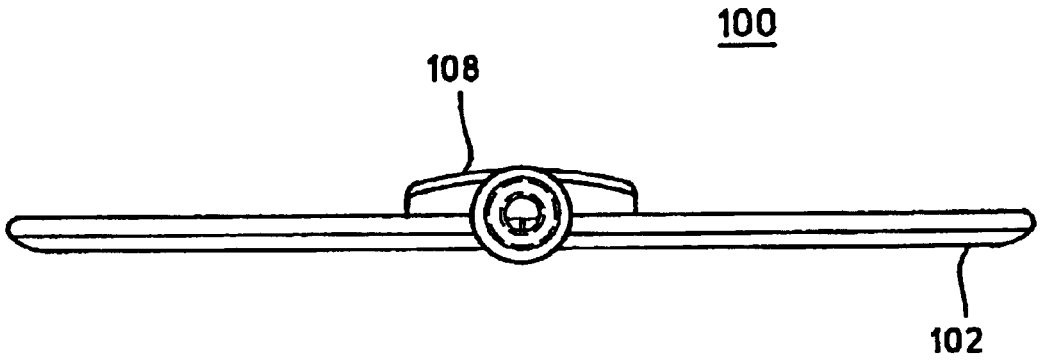
FIG. 8 is an elevation view of the showerhead shown in FIG. 1.
Figure 9:
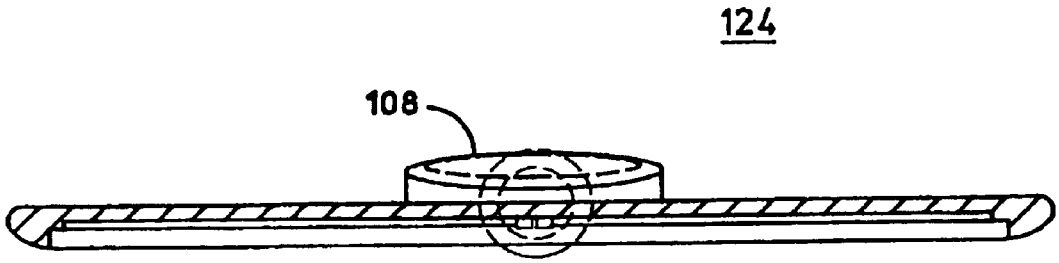
FIG. 9 is a sectional view of the showerhead (with the water distribution plate removed) as viewed from line A—A in FIG. 5.
Figure 10:
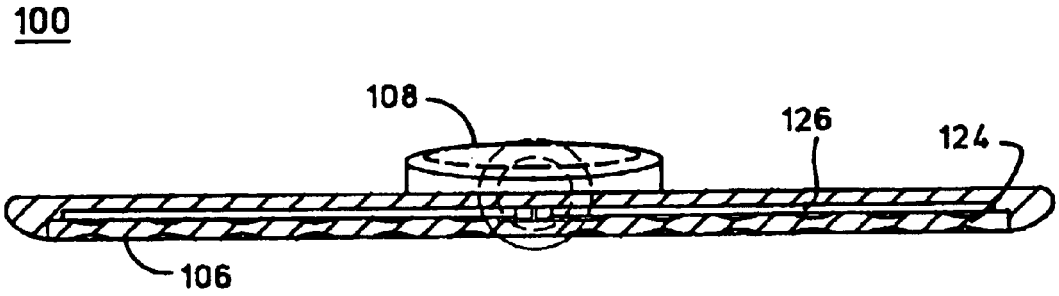
FIG. 10 is a sectional view of the showerhead (with the water distribution plate installed) as viewed from line A—A in FIG. 5.
Figure 11:
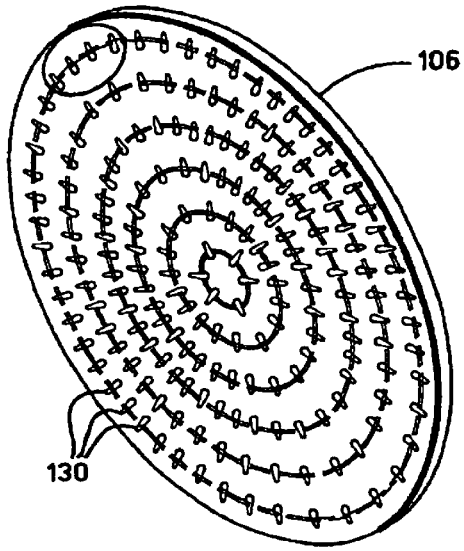
FIG. 11 is a perspective view of a water distribution plate.

FIG. 9 is a sectional view of the showerhead 100 (with the water distribution plate removed) as viewed from line A—A in FIG. 5, FIG. 10 is a sectional view of the showerhead 100 (with the water distribution plate installed) as viewed from line A—A in FIG. 5, and FIG. 11 is a perspective view of the water distribution element 106 separated from the showerhead 100. In accordance with one practical embodiment, the showerhead 100 is formed by coupling the water distribution element 106 to a main body portion 124 of the showerhead 100 as shown in FIG. 10.

Although the figures depict a generally round showerhead body, the present invention is not limited to any specific shape or size. The showerhead 100 generally includes a hollow body (which is formed by the main body portion 124 and the water distribution element 106 in the example embodiment), a fluid chamber 126 within the hollow body, and the fluid distribution element 106. Each of these components is described in more detail below.

The hollow body, and the main body portion 124 in particular, provides the structural foundation for the showerhead 100. The main body portion 124 is preferably formed from a translucent (clear or colored) or transparent material such as plastic or resin. In accordance with one practical embodiment, the main body portion 124 is formed from an optical grade plastic. Although not a requirement of the present invention, the main body portion 124 may be integrally formed as a one-piece unit. In the illustrated embodiment, the hollow body of the showerhead 100 is circular in shape and its height is substantially less than its diameter. For example, the showerhead 100 may have an overall diameter of approximately 11–12 inches, and a height of approximately 0.4 to 0.6 inches. As mentioned above, the hollow body includes a fluid inlet for receiving incoming fluid such as water. In practical applications, the fluid inlet is coupled to a joint, a conduit, a pipe, or a suitable fixture that provides water to the showerhead 100. The size, shape, and/or location of the fluid inlet on the showerhead 100 may vary from unit to unit depending upon the desired fluid flow characteristics, fluid chamber size, back pressure specifications, showerhead size, and other practical considerations.

Referring again to FIG. 10, the fluid chamber 126 is defined by the interior side of the fluid distribution element 106, and by a thin cavity formed within the main body portion 124. The fluid chamber 126 is suitably configured to receive fluid from the fluid inlet 116 via the inlet channel 122 (see FIG. 16). The hollow body is sized and shaped such that the fluid chamber 126 is relatively flat and thin. This configuration allows the fluid chamber 126 to be quickly filled and pressurized with fluid. In addition, the relatively low volume defined by the fluid chamber 126 ensures that water is conserved during operation of the showerhead 100.

The fluid distribution element 106 is attached to the main body portion 124 such that it forms an exterior surface of the showerhead 100. A practical embodiment utilizes a translucent (clear or colored) or transparent fluid distribution element 106. In this regard, the fluid distribution element 106 and the main body portion 124 can be formed from the same material, e.g., plastic, optical grade plastic, resin, plexiglass, or the like. Briefly, the fluid distribution element 106 is suitably configured to release fluid obtained from the fluid chamber 126 in a gentle dripping action. The interior side of the fluid distribution element 106 faces the fluid chamber 126 and the exterior side of the fluid distribution element 106, which is opposite the interior side, is textured with one or more fluid-releasing protrusions. The interior side is shown in FIG. 11 (with a detail view in FIG. 12), and the exterior side is shown in FIG. 14.

The fluid distribution element 106 includes one or more protrusions on its exterior side, as best shown in FIG. 3. In the illustrated embodiment, the protrusions are arranged as a plurality of raised and concentric rings 128. Each of the rings 128 has a curved convex surface when viewed in cross section (see FIG. 13). As described in more detail below, the "peaks" of the rings serve as the fluid release points due to the transport of fluid across the fluid distribution element 106. The fluid distribution element 106 also contains a number of "valleys" or depressions formed between the protrusions. As shown in FIG. 3, the example embodiment includes circular valleys formed between two concentric rings. In lieu of such rings, the fluid distribution element 106 may employ a number of raised bumps, a raised serpentine segment, intersecting protrusions, shapes having varying heights, and the like.

Figure 12:
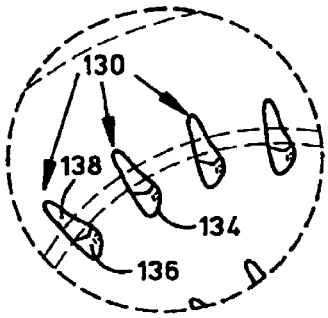
FIG. 12 is a perspective view of a detailed portion of the water distribution plate shown in FIG. 11.
Figure 13:
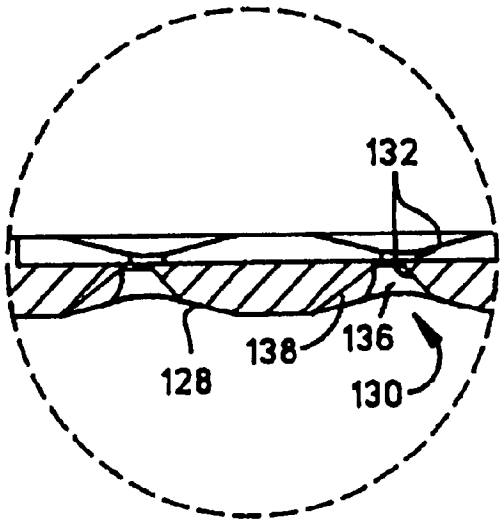
FIG. 13 is a sectional view of a detailed portion of the water distribution plate shown in FIG. 11.

The fluid distribution element 106 includes a number of ducts 130 formed therein. FIG. 12 and FIG. 13 contain detailed views of the ducts 130. Generally, each duct 130 provides a fluid path from the fluid chamber 126 to the fluid distribution surface 102 of the showerhead 100. In this regard, the fluid chamber 126 serves as a fluid source for the fluid distribution element 106. The fluid enters each duct 130 at the interior side of the fluid distribution element 106 and exits each duct 130 at the exterior side of the fluid distribution element 106. Each duct 130 includes an inlet hole 132 that terminates at the interior surface of the fluid distribution element 106, and a duct outlet 134 that terminates at the exterior surface of the fluid distribution element 106. The inlet holes 132 receive the fluid from the fluid chamber 126 and the ducts 130 transport the fluid to (or near) the fluid release points on the exterior side. In the example embodiment, the inlet holes 132 are arranged in a circular pattern as viewed from the interior side of the fluid distribution element 106 (see FIG. 14). The projected outline/perimeter of each duct outlet 134 is shown in FIG. 5; from this view, each duct outlet 134 has a teardrop shape.

Figure 14:
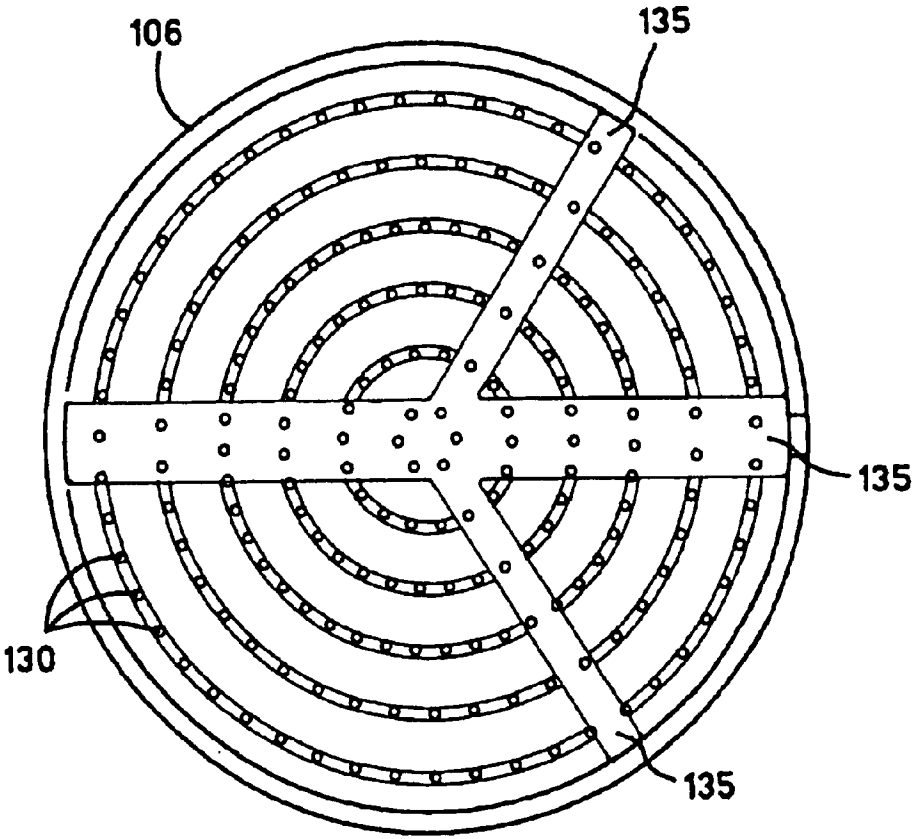
FIG. 14 is a plan view of the opposite side of the water distribution plate shown in FIG. 11.

The interior side of the fluid distribution element 106 may include one or more channels 135 formed therein (see FIG. 14). These channels 135 direct the flow of fluid from the inlet of the showerhead 100 to various points within the fluid chamber 126. The channels 135 can be sized and shaped to promote uniform fluid pressure within the fluid chamber 126 such that drops are evenly formed across the fluid distribution element 106.

Although the specific size, shape, and configuration of each duct 130 may vary from one practical embodiment to the next, and/or vary within the fluid distribution element 106 for a given practical embodiment, the preferred duct configuration is depicted in the drawings of the example embodiment. Each duct 130 generally includes the inlet hole 132, a tapered outlet section 136 connected to the inlet hole 132, and a groove 138 connected to the inlet hole 132. The groove 138 is also connected to the tapered outlet section 136. These features of the duct 130 are shown in FIG. 12 and FIG. 13. The groove 138 and the tapered outlet section 136 combine to form the duct outlet 134 at the exterior side of the fluid distribution element. Notably, the inlet hole 132 represents the narrowest portion of duct 130, and the area of the duct outlet 134 is greater than the area of the inlet hole 132.

In the example embodiment, the tapered outlet section 136 has a partial-cone shape. As shown in FIG. 12 and FIG. 13, the coned portion of the duct 130 flares outward from the inlet hole 132. The groove 138 intersects a side of the tapered outlet section 136 and creates an extended spout or flute for the duct 130. The groove 138 is suitably configured to laterally transport fluid across the fluid distribution element 106 from the inlet hole 132 toward the respective fluid release point on the fluid distribution surface 102. As depicted in FIG. 5, each groove 138 extends radially outward from the respective inlet hole 132 (alternate configurations may be utilized, and this specific layout is not intended to limit or otherwise restrict the scope of the invention). As described above, the fluid distribution element 106 includes a number of protrusions (e.g., raised rings 128) that facilitate the collection and release of fluid. In the preferred practical embodiment, the grooves 138 extend across the raised rings 128 and terminate at or near the peaks on the raised rings 128. Consequently, the water seeps into the inlet hole 132, clings to the walls of the tapered outlet section 136, and the groove 138 directs the water to the drip ring protrusions. This positioning of the grooves 138 relative to the protrusions facilitates the desired drop formation and cascade pattern.

Figure 19:
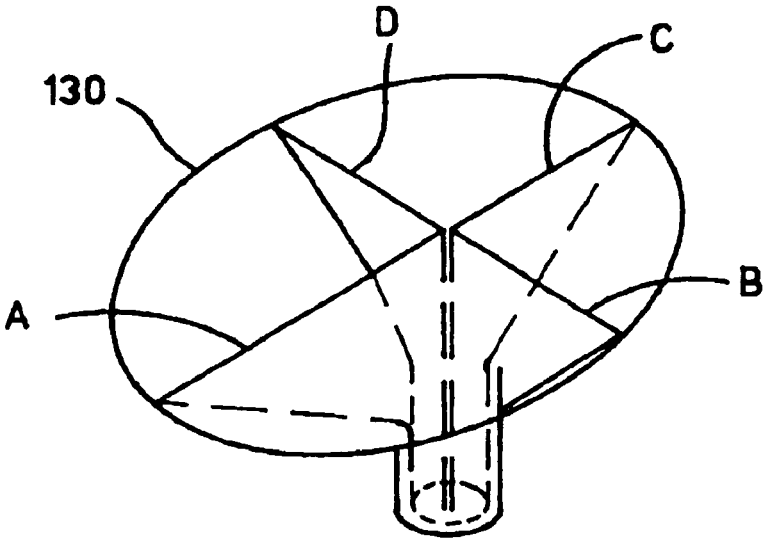
FIG. 19 is a schematic perspective view of a fluid duct, with shape planes defined therein.

FIG. 19 is a schematic perspective view of an example duct 130, along with four imaginary shape planes that can be used to define the shape and dimensions of the duct 130. The first shape plane (designated by the letter "A") corresponds to the groove portion of the duct 130. The second shape plane (designated by the letter "B"), third shape plane (designated by the letter "C"), and fourth shape plane (designated by the letter "D") generally define the tapered outlet section 136 of the duct 130. The third shape plane opposes the first shape plane, and the second and fourth shape planes oppose each other.

Figure 21:
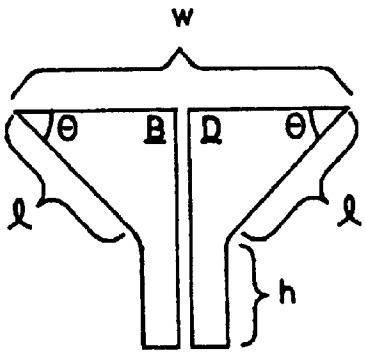
FIG. 21 is an elevation view of the second and fourth shape planes shown in FIG. 19.
Figure 20:
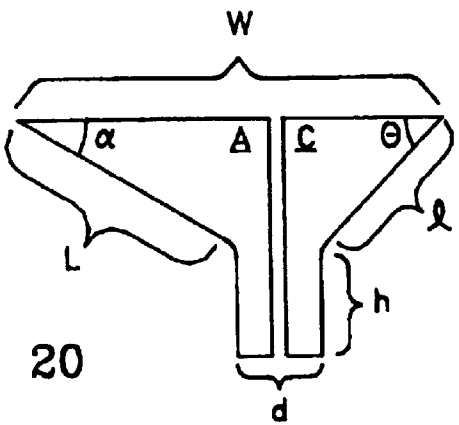
FIG. 20 is an elevation view of the first and third shape planes shown in FIG. 19.

FIG. 20 is an elevation view of the first and third shape planes shown in FIG. 19, and FIG. 21 is an elevation view of the second and fourth shape planes shown in FIG. 19. The diameter d of the inlet hole 132 is approximately 0.093 inches, the width W at the widest portion of the duct 130 is approximately 0.543 inches, and the width w at the tapered outlet section 136 is approximately 0.422 inches. The length l of the sidewall of the tapered outlet section 136 is approximately 0.199 inches, the length L of the sidewall of the groove portion is approximately 0.292 inches, and the height h of the inlet hole 132 is approximately 0.100 inches. The tapered outlet section 136 forms an angle θ with the horizontal reference line and the groove portion forms an angle α with the horizontal reference line. In the example embodiment, θ is approximately 40 degrees and α is approximately 25 degrees. It should be appreciated that the shape and dimensions of the ducts 130 can vary to suit the needs of the particular embodiment.

The shape of each duct 130 can be further visualized in conjunction with the following description of one suitable manufacturing process. First, a relatively small pilot hole is drilled into the fluid distribution element 106 at a point located between two adjacent raised rings 128. A portion of this pilot hole will correspond to the inlet hole 132 of the finished duct 130. Next, a countersink is formed in the end of the pilot hole corresponding to the exterior side of the fluid distribution element 106. A portion of the countersink shape will correspond to the tapered outlet section 136. Finally, the groove 138 is formed such that it intersects the side of the countersink.

As mentioned previously, the fluid distribution element 106 includes at least one protrusion extending beyond the point where fluid seeps through the inlet holes 132. In this regard, the protrusions provide a texturized outer surface for the fluid distribution element 106. In the normal operating orientation, water is released at a relative high point before traveling through the ducts 130 and onto the protrusions. Eventually, the water drops from the relative low points (the fluid release points) defined by the protrusions.

Figure 18:
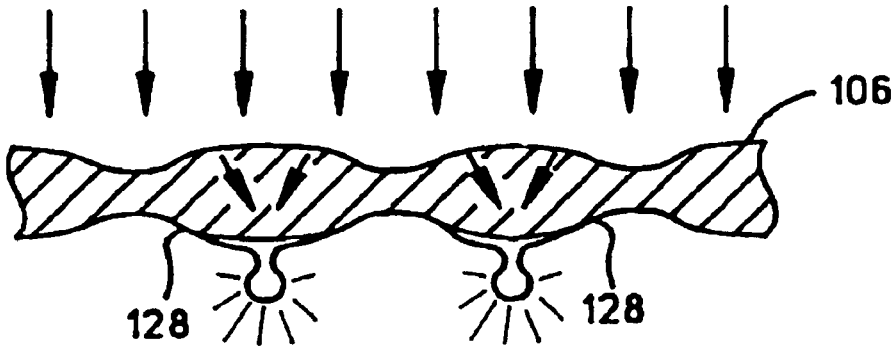
FIG. 18 is a schematic representation of a portion of a water distribution plate with water droplets formed thereon.

The creation of a substantially uniform and distributed back pressure of fluid within the fluid chamber 126, in conjunction with the configuration of the fluid distribution element 106, facilitates the even release of fluid droplets across the face of the showerhead 100. Relying upon the surface tension of the fluid and the configuration of the ducts 130, the fluid distribution element 106 transports the fluid from the inlet holes 132 located above the textured drip point on the face of the fluid distribution element 106. The result is the formation of a droplet as the fluid travels to the fluid release points defined by the peaks of the protrusions. The drops are forced in a relatively slow manner from the face of the fluid distribution element 106 by both gravity and by continuing seepage from the fluid chamber 126. This surface tension effect and the formation of droplets is depicted in FIG. 18. Notably, the droplet size can vary depending upon the specific texturing of the fluid distribution element 106. For instance, larger bumps, peaks, raised ridges, or texturing can generate larger droplets, and smaller bumps, peaks, raised ridges, or texturing can generate smaller droplets. Generally, the size and shape of each protrusion in the texture pattern can be designed such that it retains more or less water before releasing the droplet.

The showerhead 100 can also include an optical lens element that is configured to receive incident light rays, refract the light rays, and create exiting light rays that illuminate outgoing fluid emitted from the fluid distribution element 106. In the example embodiment, the optical lens element is incorporated into the body of the showerhead 100. For example, both the main body portion 124 and the fluid distribution element 106 can be formed from a translucent or transparent material that accommodates the transmission and propagation of light. In the illustrated embodiment, the optical lens element is integral to the fluid distribution element 106. More particularly, the raised concentric rings 128 serve as the optical lens element, where each ring 128 can be considered to be a separate lens component. Accordingly, the protrusions on the fluid distribution element 106 are configured to distribute the water and form droplets in a predictable manner, and to provide the optical lens effect.

As shown in FIG. 3, each of the raised rings 128 has a convex external surface. In practice, the convex shape of the rings 128 produces the optical lens effect for refracting and focusing light. As depicted in FIG. 13 and FIG. 18, the interior side of the fluid distribution element 106 may also include a pattern of raised concentric rings that matches the pattern on the opposite side. Consequently, each ring 128 can be realized as a ring-shaped lens having two opposing convex surfaces. FIG. 18 includes a schematic representation of how incident light rays (shown as vertical and parallel arrows) are received and refracted by the fluid distribution element 106. In practice, the optical lens feature of the showerhead 100 can focus or direct the light rays toward the fluid release points on the fluid distribution element 106. In this manner, droplets of water can be illuminated as they are being formed on the fluid distribution element 106 and as they are released from the showerhead 100. FIG. 18 depicts two droplets being illuminated by light rays focused by the raised concentric rings 128 of the example embodiment.

FIG. 4 is intended to illustrate the translucent or transparent nature of the showerhead 100. If the entire hollow body of the showerhead 100 is formed from a translucent material, then incident light rays can enter the fluid distribution element from any number of directions. The incident light ray can be natural sunlight and/or generated by one or more lighting fixtures. The incident light can be white or, if generated artificially, colored or polarized using appropriate lenses. The body of the showerhead 100 may be formed from a colored translucent material such that the spectrum of the incident light is modified as it passes through the optical lens element. Furthermore, fluid and/or bubbles passing through the hollow body of the showerhead 100 can modify the characteristics of the exiting light rays, resulting in varied optical effects experienced by the user.

As water drips from the showerhead 100, the optical lens element concentrates light on the water droplets, thus creating a scintillating, sparkling, flickering, and/or "firefly" effect as the water is released from the showerhead 100. Indeed, the showerhead 100 itself can also be illuminated to provide a lamp or glowing effect. Different visual effects can be generated depending upon the orientation, intensity, color, and configuration of the light source or sources. These lighting effects can enhance the showering experience for the user.

The present invention has been described above with reference to a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims.

What is claimed is:

1. A showerhead comprising an optical lens element configured to emit a fluid and to receive incident light rays, refract said incident light rays, and create exiting light rays that illuminate outgoing fluid emitted from said optical lens element.

2. A showerhead according to claim 1, further comprising a hollow body having a fluid inlet for incoming fluid, the hollow body in fluid communication with a plurality of fluid outlets formed in said optical lens element.

3. A showerhead according to claim 2, wherein said hollow body is formed from a translucent material.

4. A showerhead according to claim 3, wherein said hollow body is formed from a colored translucent material.

5. A showerhead according to claim 2, wherein fluid passing through said hollow body modifies the characteristics of said exiting light rays.

6. A showerhead according to claim 2, wherein said hollow body is formed from an optical grade plastic.

7. A showerhead according to claim 1, wherein said optical lens element comprises a plurality of concentric ring-shaped lenses.

8. A showerhead according to claim 7, wherein each of said concentric ring-shaped lenses has a convex external surface.

9. A showerhead comprising:

a hollow body configured to receive incoming fluid;

a fluid distribution element configured to release outgoing fluid from said hollow body; and an optical lens element integral to said fluid distribution element, said optical lens element having integral fluid outlets for passage of said outgoing fluid, said optical lens element being configured to receive incident light rays, refract said incident light rays, and create exiting light rays that illuminate said outgoing fluid passed from said optical lens element.

10. A showerhead according to claim 9, wherein a portion of said hollow body forms said fluid distribution element.

11. A showerhead according to claim 9, wherein said hollow body is formed from a translucent material.

12. A showerhead according to claim 11, wherein said hollow body is formed from a colored translucent material.

13. A showerhead according to claim 9, wherein said hollow body is formed from an optical grade plastic.

14. A showerhead according to claim 9, wherein said optical lens element comprises at least one convex protrusion configured to transport said outgoing fluid toward a fluid release point on said fluid distribution element.

15. A showerhead according to claim 14, wherein said at least one convex protrusion comprises a plurality of concentric ring-shaped lenses.

16. A showerhead comprising:

a fluid inlet for receiving incoming fluid; and a translucent hollow body connected to said fluid inlet, said translucent hollow body having optical lens element configured to pass a fluid, and further configured to receive incident light rays, refract said incident light rays, and create exiting light rays that illuminate said fluid gassed through said optical lens element.

17. A showerhead according to claim 16, wherein fluid passing through said translucent hollow body modifies the characteristics or said exiting light rays.

18. A showerhead according to claim 16, wherein said translucent hollow body is formed from an optical grade plastic.

19. A showerhead according to claim 16, wherein said optical lens element comprises at least one convex ring-shaped lens.

* * * * *